US005398097A

United States Patent [19]

Satoh et al.

[11] Patent Number: 5,398,097

[45] Date of Patent: Mar. 14, 1995

[54] IMAGE FORMING APPARATUS WITH DRIVING MECHANISM FOR PHOTORECEPTOR

[75] Inventors: Hisao Satoh; Satoshi Haneda; Tadayoshi Ikeda Shizuo Morita; Masakazu Fukuchi, all of Hachioji, Japan

[73] Assignee: Konica Corporation, Tokyo, Japan

[21] Appl. No.: 97,947

[22] Filed: Jul. 26, 1993

Related U.S. Application Data

[63] Continuation of Ser. No. 833,998, Feb. 11, 1992, abandoned.

[30] Foreign Application Priority Data

Feb. 14, 1991 [JP] Japan ..... 3-21113

[51] Int. Cl.[6] ..... G03G 15/00

[52] U.S. Cl. ..... 355/200; 355/212

[58] Field of Search ..... 355/200, 210, 211, 212, 355/245, 326, 327; 74/421 A, 572, 574

[56] References Cited

U.S. PATENT DOCUMENTS

| | | | |
|---|---|---|---|
| 4,080,845 | 3/1978 | Hatch | 74/572 X |
| 4,270,410 | 6/1981 | Herscovici | 74/572 X |
| 4,875,077 | 10/1989 | Takamatsu et al. | 355/212 |
| 4,935,778 | 6/1990 | Mochida | 355/211 |
| 5,047,803 | 9/1991 | Kanoto | 355/211 |
| 5,065,195 | 11/1991 | Haneda et al. | 355/212 X |

FOREIGN PATENT DOCUMENTS

| | | |
|---|---|---|
| 0052170 | 2/1989 | Japan . |
| 0154278 | 6/1990 | Japan . |
| 0173780 | 7/1990 | Japan . |

*Primary Examiner*—Robert B. Beatty

*Attorney, Agent, or Firm*—Frishauf, Holtz, Goodman & Woodward

[57] ABSTRACT

An image forming apparatus includes a process cartridge that incorporates a photoreceptor and a plurality of developing devices. The process cartridge is provided with a first driving shaft to drive the photoreceptor and a second driving shaft to independently drive the developing devices. When the process cartridge is mounted in the image forming apparatus which includes spaced apart first and second gears, the first and second driving shafts are coupled separately with the spaced apart first and second gears so that driving forces are separately transmitted to the first and second driving shafts. A flywheel is mounted on a third driving shaft that is coupled with the first driving shaft to drive the photoreceptor. Since the developing devices are constructed to receive a large number of different possible loads, the developers are placed in a condition where vibrations are created easily by the driving of the various possible loads. The driving of the photoreceptor is arranged to be independent of the driving of the developing devices so that vibrations generated by the driving of the developing devices are not transmitted to the photoreceptor. Furthermore, the flywheel is provided on the third driving shaft, and a third gear is mounted on the third driving shaft. Since the third gear is coupled with the first driving shaft to drive the photoreceptor, the rotation of the photoreceptor will be smoothed out by the presence of the flywheel.

5 Claims, 4 Drawing Sheets

IMAGE FORMING APPARATUS WITH DRIVING MECHANISM FOR PHOTORECEPTOR

This application is a continuation of application Ser. No. 07/833,998, filed Feb. 11, 1992, now abandoned.

BACKGROUND OF THE INVENTION

The present invention relates to an image forming apparatus detachably provided with a cartridge to which process materials for image formation such as an image carrier and the like, are integrally assembled.

As an apparatus in which a color image can be obtained by an electrophotographic method, there is the following apparatus in which: latent image formation according to a number of separated colors of a document image and development by color toners are repeatedly conducted on a photoreceptor drum or photoreceptor belt; color toner images are superimposed on the photoreceptor drum or the photoreceptor belt; and after that, they are transferred so that a color image can be obtained. A basic process of the multi-color image formation is disclosed in Japanese Patent Publication Open to Public Inspection Nos. 75850/1985, 76766/1985, 95456/1985, 95458/1985, and 158475/1985, by the inventors of the present invention.

In a multi-color image forming apparatus in which a color image can be obtained by the aforementioned superimposition, a plurality of developing units, in which different color toners are contained, are provided around the photoreceptor, and generally the photoreceptor is rotated by plural turns so that latent images can be developed, and after that, a color image can be obtained on a transfer paper by a transfer unit which is provided opposite to a peripheral surface of the photoreceptor.

With respect to the aforementioned image forming apparatus, the apparatus having the following structure has been proposed. That is, some of the image forming means are provided in the form of a cartridge for supply or replacement when the photoreceptor, developer carrier, a cleaning member or developer toner, the lives of which are limited, are consumed, and a member into which a main section of the image forming means is integrated is removed from the apparatus so that maintenance or replacement can be conducted. Further, a structure in which a conveyance path of a transfer material on which an image is formed by an image forming means, is accessible so that the transfer material can be easily removed when jamming occurs, has been proposed.

Furthermore, in the image forming apparatus of a digital type, a laser writing system is used as a latent image forming means on the photoreceptor, and in many cases, the laser writing system is detachably provided in the form of a unit, the same as the aforementioned process cartridge, so that cleaning and inspection can be conducted easily.

As for the process cartridge of the aforementioned image forming apparatus, it is necessary that the process cartridge is automatically connected with or detached from a driving means provided in the apparatus main body. Usually, a method by which the process cartridge is detachably connected with the drive means through a gear, is applied as the means required above. However, in power transmission through the gear, accurate and smooth transmission of rotation speed is difficult due to delicate variations of engagement between teeth of gears, or high frequency noises from peripheral units to a motor as a driving source, and slight fluctuations of the rotation can be generated, and thereby, sometimes, image quality can be lowered, especially with regard to the photoreceptor.

For the purpose of making up the disadvantages in power transmission through the gears, the following method has been proposed in which: a flywheel is provided on a rotation shaft of the photoreceptor so that the photoreceptor can be smoothly rotated. However, as is commonly known, the photoreceptor is rotated at a relatively low speed, and therefore, a large effect of inertia can not be obtained. Further, when the flywheel is provided, there are disadvantages in which: volume and weight of the process cartridge is increased, and thereby operability is lowered.

SUMMARY OF THE INVENTION

In view of the foregoing problems, the present invention has solved and improved them as follows. An object of the present invention is to provide an image forming apparatus in which a photoreceptor can be smoothly rotated without fluctuation by a large effect of inertia without influencing operability of a cartridge.

The aforementioned object is accomplished by an image forming apparatus characterized in that: a belt-like photoreceptor is stretched around rollers including a drive roller; a developing means is provided around the photoreceptor; and a latent image on the photoreceptor is developed so that a toner image can be formed, wherein the aforementioned drive roller is rotated by power of a motor, the aforementioned power is transmitted through an intermediate driving power transmission shaft, which is provided with a flywheel or a member having a flywheel effect, and wherein a transfer unit which is provided opposite to the outer peripheral surface of the belt-like photoreceptor with a constant distance therefrom and transfers a toner image onto a transfer paper, is provided on the drive roller side in which a position of a shaft center is fixed.

DETAILED DESCRIPTION OF THE PREFERRED EMBODIMENT

An example of the image forming apparatus of the present invention is shown in FIG. 1 to FIG. 4.

Figure 1:
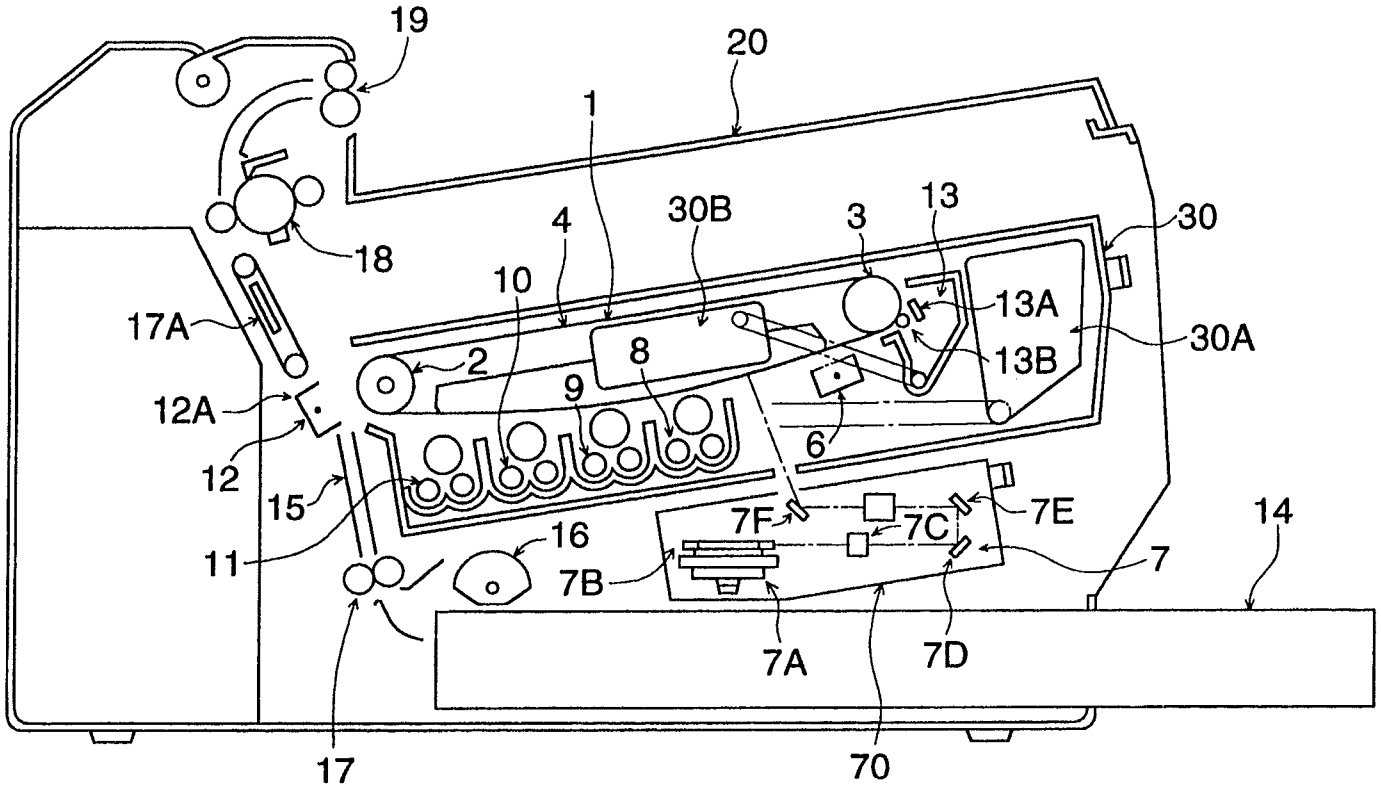
FIG. 1 is a sectional view showing a structure of an image forming apparatus of the present invention.

In FIG. 1, numeral 1 is a flexible photoreceptor belt which is a belt-like photoreceptor. The photoreceptor belt is stretched between a drive roller 2 and a driven roller 3, and is conveyed clockwise by the drive roller 2.

Numeral 4 is a support member, that is, a guide member which is fixed to the apparatus main body and can be inscribed in the photoreceptor belt 1, wherein tension is given to the photoreceptor belt 1 since the driven roller 3 is pushed outward so that the aforementioned guide member can slidably contact with an inner peripheral surface of the photoreceptor belt 1.

Accordingly, the photoreceptor on the outer peripheral surface of the aforementioned photoreceptor belt 1 is held always with a constant distance from the surface of the aforementioned guide member 4 even in a conveyance operation, and thereby a stable image forming surface can be structured.

Numeral 6 is a scorotron charger, which is a charging means, numeral 7 is a laser writing system unit, which is an image exposure means, and numerals 8 to 11 are developing means, that is, a plurality of developing units which contain a specific colored developer respectively. Each image forming means is provided opposite to the outer peripheral surface of the photoreceptor belt 1, to the back of which the guide member 4 is provided.

Apart from the optical system shown in the drawings, an optical system in which a light emitting section is integrally provided with a convergent light transmitter, can be used for the aforementioned laser writing unit 7.

The aforementioned developing units 8, 9, 10, and 11 contain, for example, yellow, magenta, cyan, and black developers respectively, have developing sleeves which keep a predetermined gap from the photoreceptor belt 1, and have a function by which a latent image on the photoreceptor belt 1 is visualized by the method of non-contact development. The method of non-contact development has an advantage by which movement of the photoreceptor is not prevented differently from the method of contact development.

Numeral 12 is a transfer unit which is provided, with a constant distance from the belt-like photoreceptor which is stretched between rollers including the drive roller, opposite to the outer peripheral surface of the belt-like photoreceptor on the drive roller side. In order to give tension to the belt-like photoreceptor, a roller apart from the drive roller is moved through a resilient member such as a spring or the like (not shown). Numeral 12A is a discharge bar. Numeral 13 is a cleaning unit. A blade 13A of the cleaning unit 13 and a toner conveyance roller 13B are held in a position apart from the surface of the photoreceptor belt 1, and are contacted with the surface of the photoreceptor belt 1 as shown in the drawings only when cleaning is conducted after an image transfer.

Color image forming by the aforementioned image forming apparatus is conducted as follows.

Multi-color image formation in the example is conducted according to the following image forming system. Data obtained in a color image data input section in which an original image is scanned by an image pick-up element, is arithmetically processed in an image data processing section so that image data can be made, and the image data is stored once in an image memory. Next, the image data in the image memory is read out when recording is conducted, and is inputted into a color image forming apparatus, which is a recording section, for example, shown in FIG. 1.

When a color signal outputted from an image reading device which is separately provided from the aforementioned printer, is inputted into the laser writing system unit 7, rotational scanning is performed by a laser beam generated from a semiconductor laser (not shown) with a polygonal mirror 7B which is rotated by the drive motor 7A, and the laser beam is reflected by mirrors 7D, 7E, and 7F through an $f\theta$ lens 7C, and then projected on the peripheral surface of the photoreceptor belt 1 upon which an electric charge has been given by the charger 6 which is a charging means, so that a bright line can be formed on the surface of the photoreceptor belt 1.

When scanning is started, the beam is detected by an index sensor, beam modulation by a first color signal is started, and the modulated beam scans the aforementioned surface of the photoreceptor belt 1. Accordingly, a latent image according to the first color is formed on the surface of the photoreceptor belt 1 by primary scanning by the laser beam and subsidiary scanning by conveyance of the photoreceptor belt 1. The latent image is developed by the developing unit 8 loaded with a yellow (Y) toner (visual image media) in the developing means, and a toner image is formed on the surface of the belt. The obtained toner image passes under the cleaning unit 13 which is a cleaning means and is separated from the peripheral surface of the photoreceptor belt 1, while the toner image is held on the surface of the belt, and the operation enters the next copy cycle.

That is, the aforementioned photoreceptor belt 1 is charged again by the charger 6. Next, a second color signal outputted from the signal processing section is inputted into the aforementioned writing system unit 7, and writing on the surface of the photoreceptor belt is conducted in the same way as the case of the aforementioned first color signal so that the latent image can be formed. The latent image is developed by the developing unit 9 loaded with a magenta (M) toner as a second color.

The magenta toner image is formed on the aforementioned yellow (Y) toner image which has been formed before.

Numeral 10 is the developing unit loaded with a cyan (C) toner, and forms a cyan (C) toner image on the surface of the photoreceptor drum according to a control signal generated in the signal processing section.

Numeral 11 is the developing unit loaded with a black toner, and forms a black toner image by superimposition on the surface of the photoreceptor belt by the same processing described above. A D.C. or an A.C. bias voltage is impressed upon each sleeve of developing units 8, 9, 10, and 11, and jumping development, in other words, non-contact development, by a two-component developer, which is a visual image means, is conducted on the photoreceptor a frame of which is grounded. Further, a noncontact development method using one-component developer can be used as a developing method.

Thus, the color toner image formed on the peripheral surface of the photoreceptor belt 1 is transferred onto a transfer paper which is fed from a paper feeding cassette 14 through a paper feeding passage 15 in the transfer section.

That is, the uppermost sheet of the transfer material loaded in the paper feeding cassette 14 is conveyed by rotation of a paper feeding roller 16 and supplied to the transfer unit 12 through a timing roller 17 synchronously with image formation on the photoreceptor belt 1.

The transfer material onto which the image is transferred, and from which the electric charge is discharged, is positively separated from the photoreceptor belt 1, the movement direction of which is suddenly changed around the aforementioned driven roller 2, and is moved upward through an attraction type conveyance belt 17A, and the image is fused by a fixing roller 18, and after that, the transfer material is discharged through a discharging roller 19 on a tray formed on an upper cover 20.

The photoreceptor belt 1 from which the image has been transferred onto the transfer material, is further conveyed. Residual toner on the photoreceptor belt is removed by the aforementioned cleaning unit 13 in which the blade 13A and the conveyance roller 13B come into contact with the photoreceptor belt 1, and after that, the aforementioned blade 13A is separated again from the photoreceptor belt 1. A little after that, the toner conveyance roller 13B levels toner deposited on a tip of the blade 13A, and then the toner conveyance roller 13B is separated from the photoreceptor belt 1 so that the operation enters a new image forming process.

The aforementioned photoreceptor drum 1, charger 6, each developing unit, and cleaning unit 13 are integrally incorporated into an independent process cartridge 30 as process materials for image formation, and detachably provided to the apparatus main body.

As shown in FIG. 1, process cartridge 30 includes a toner cartridge 30A and a waste toner container 30B for collecting waste toner removed from the photoreceptor belt.

On the other hand, the aforementioned laser writing system unit 7 is integrally incorporated into a frame 70 and detachably provided to the apparatus main body, the same as the aforementioned process cartridge 30.

Figure 2:
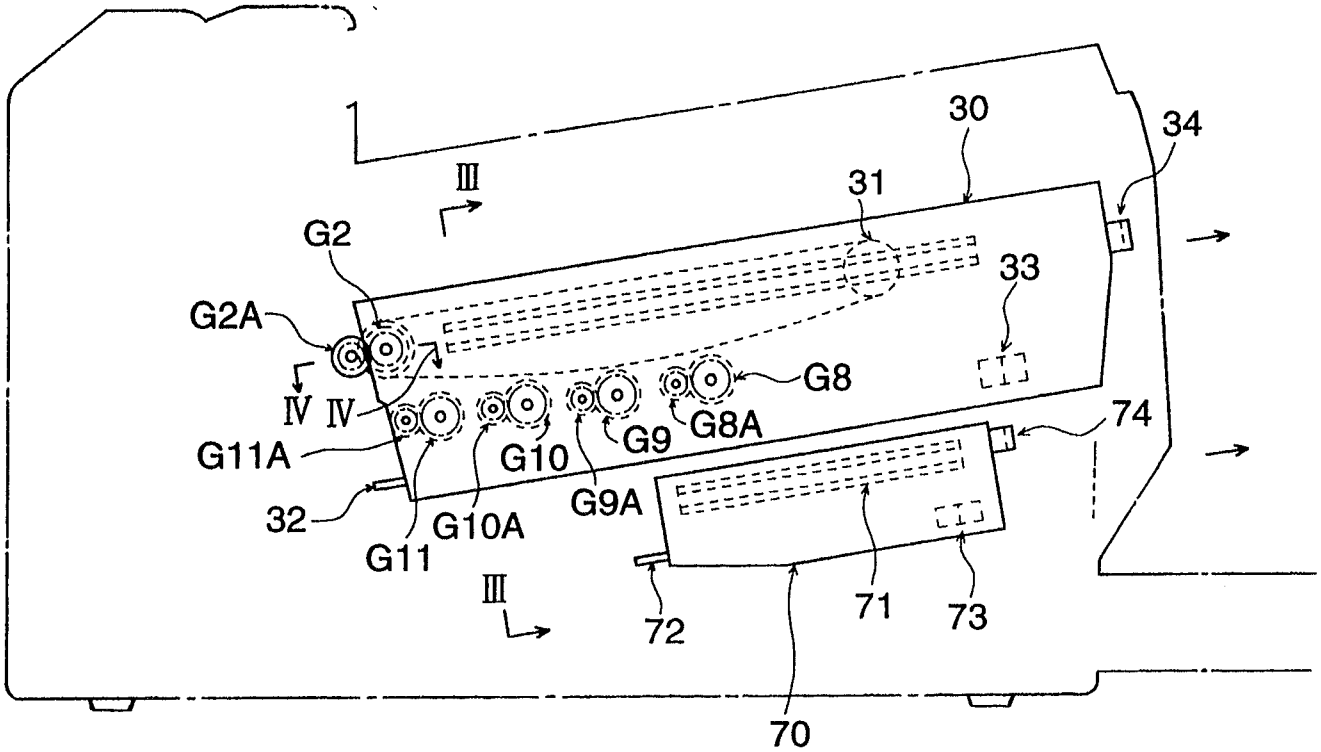
FIG. 2 is an illustration showing a main portion of the apparatus.

The aforementioned process cartridge 30 and the frame 70 in which the aforementioned laser writing system unit 7 is housed, are slidably provided in the apparatus from the upper right side as shown in FIG. 2 through a guide unit 31 or 71 structured between the rear side of the apparatus and the apparatus main body, and they come into contact with a stopper 32 or 72 respectively so that they can be set in each installation position.

A first gear G2, and second gears G8, G9, G10, and G11 are fixed on elongated shafts, which protrude to the rear section of the apparatus, of the aforementioned drive roller 2 and the developing sleeve of each developing unit. At the same time when the process cartridge is set in its installation position, the gears are engaged simultaneously with third gear and fourth gears, G8A, G9A, G10A, and G11A which are provided in the apparatus main body.

In the aforementioned process cartridge 30 and the frame 70, a connector 33 or 73, each provided on their rear section, is connected with a power source unit provided on the apparatus main body, in their installation positions. The high voltage electric power for charging, and the electric power for the cleaning member can be supplied to the process cartridge 30, and electric power for driving the motor, and each signal for writing and control can be supplied and transmitted to the frame 70.

Accordingly, when the aforementioned process cartridge 30 and frame 70 are pulled out in the arrowed direction through a knob 34 or 74, a condition on which image forming can be conducted is automatically cancelled, so that the process cartridge 30 and the frame 70 can be removed from the apparatus main body.

Figure 3:
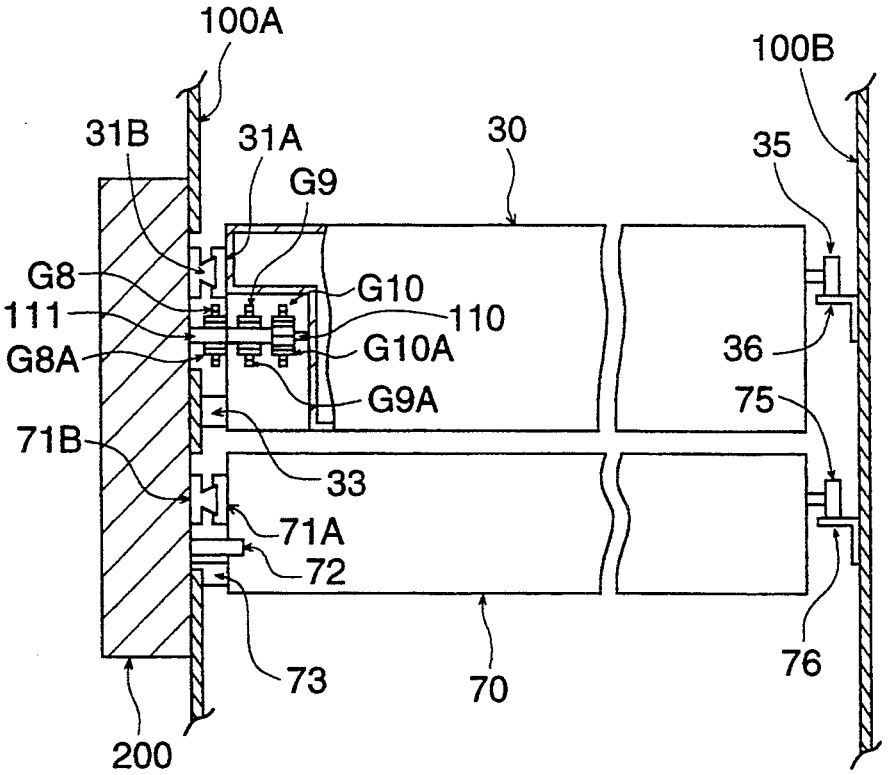
FIG. 3 is a sectional view showing a main portion of a process cartridge in the apparatus.

FIG. 3 is a sectional view taken on line III—III in FIG. 2.

The aforementioned guide units 31 and 71 are composed of a guide member 31A or 71A which have U-shaped wedge sections, and a guide member 31B or 71B which have protruded wedge sections, and the guide members 31A and 71A are fixed on the rear side surface of the process cartridge 30 or the frame 70. On the other hand, both guide members 31B and 71B penetrate a panel 100A of the main body on the rear side, and are directly fixed to the drive unit 200, which is provided outside the panel, of the apparatus main body.

Figure 4:
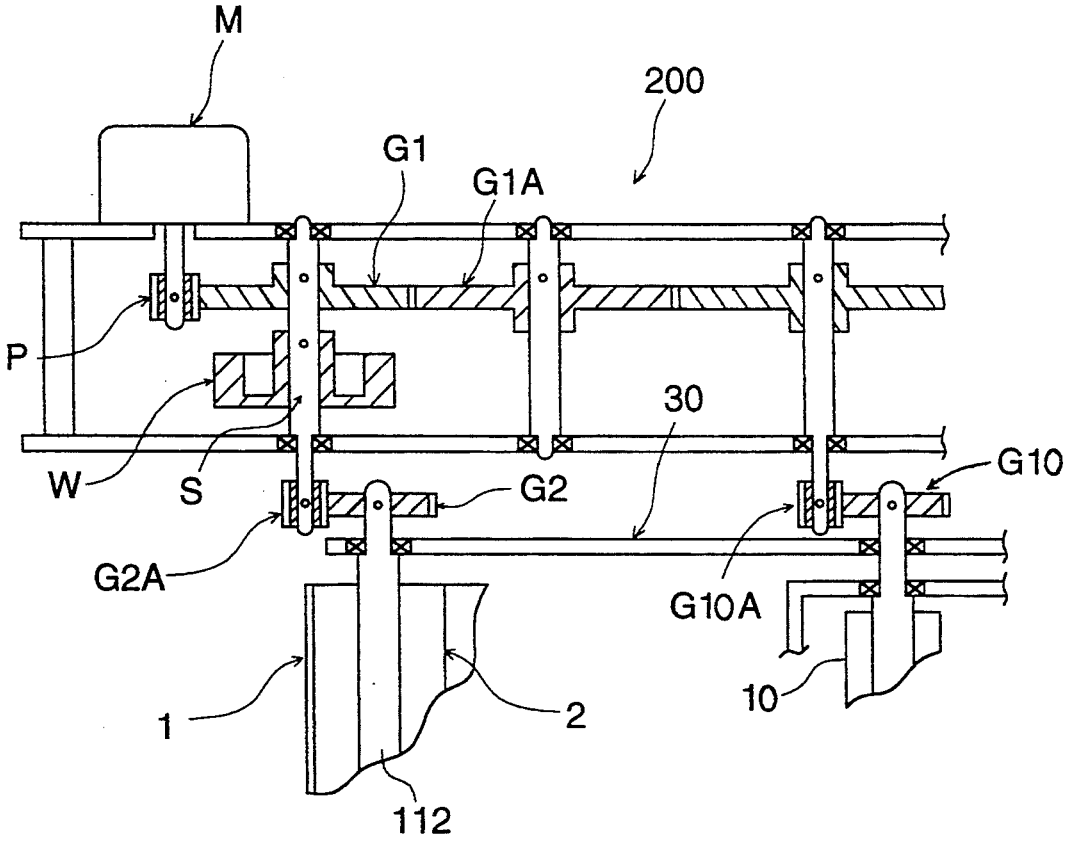
FIG. 4 is a sectional view showing a main portion of a drive unit in the apparatus.

In FIG. 3, a fourth drive shaft 111 and a second drive shaft 110 are coupled to drive unit 200. In FIG. 4, a first drive shaft 112 and a third shaft S are shown; the first drive shaft 112 rotates the imaging surface 1 of FIG. 4. The third drive shaft S is an intermediate power transmission shaft which has third gear G2A mounted on an end portion thereof.

A rotatable roller 35 is protrusively provided on the front section of the process cartridge 30, and a rotatable roller 75 is protrusively provided on the front section of the frame 70. The process cartridge 30 and the frame 70 are supported respectively by a support 36 or 76 on a panel 100B of the main body which is provided in parallel with the guide units 31 and 71, and thereby they can be installed in the apparatus under a balanced condition in a front or rear direction.

Accordingly, since installation positions of both the, process cartridge 30 and frame 70 are directly regulated by the drive unit 200, and not through any of main body panels 100A and 100B, the drive unit system can be properly connected, and an incident position of the laser beam can be always stable so that the image can be accurately formed.

FIG. 4 is a sectional view taken on line IV–IV in FIG. 2.

The motor M, and the third intermediate driving power transmission shaft S with which the gear G1, which is engaged with the pinion P on the rotating shaft of the motor M, is integrally provided, are provided in the drive unit system 200.

The third intermediate driving power transmission shaft S is provided with a third gear G2A on the tip of the shaft S, which is engaged with a first gear G2 on the elongated shaft 112 of the drive roller 2. The aforementioned gear G1 is engaged with the gear G1A which is engaged with the gear G8A, G9A, G10A and G11A to drive each developing sleeve (see FIG. 2). The first drive shaft 112 rotates the imaging surface 1 as shown in FIG. 4.

The aforementioned intermediate driving power transmission shaft S is provided with a flywheel W on its shaft, by which large inertia is produced in its rotation direction by the relatively high speed rotation of the motor M.

Accordingly, the intermediate driving power transmission shaft S is not subjected to fluctuation of rotation by high frequency noises, and rotates the drive roller 2 through the third gear G2A so that the photoreceptor belt 1 can always be conveyed stably with a predetermined speed. The aforementioned flywheel W may be replaced by the gear G1 which is integrally provided with the flywheel W so that it can produce inertia in the intermediate driving power transmission shaft S.

According to the present invention, a belt-like photoreceptor housed in an process cartridge which is detachably provided to an apparatus main body, can always be driven and rotated with a stable speed and conveyance force, and even when elongation or contraction of the belt-like photoreceptor by environmental temperature changes, and elongation of the photoreceptor by belt tension are caused, the distance between the photoreceptor surface and a transfer unit can always be constant. As a result, an image forming apparatus can be provided to which a small and light cartridge can be installed, by which a high quality image can be obtained.

What is claimed is:

1. An apparatus for forming an image comprising:

a process cartridge detachably mounted to said apparatus, said process cartridge having:

a photoreceptor on which a toner image is formed;

developing means for developing the toner image on said photoreceptor;

a first driving shaft for rotating said photoreceptor;

a second driving shaft for rotating said developing means independently of a rotation of said photoreceptor;

first gear means mounted on said first driving shaft;

second gear means spaced apart from said first gear means, said second gear means being mounted on said second driving shaft;

a housing for integrally supporting said photoreceptor, said developing means, and said first and second driving shafts;

third gear means mounted on a third driving shaft, for transferring a driving power from a driving power source to said first gear means when said process cartridge is mounted in said apparatus;

fourth gear means mounted on a fourth driving shaft, for transferring said driving power from said driving power source to said second gear means, independent of transferring of driving power to said first gear means, when said process cartridge is mounted in said apparatus;

a guide member for guiding a movement of said process cartridge in a direction that is perpendicular to said third driving shaft;

a flywheel mounted on said third driving shaft for smoothing out any fluctuations in rotation of said third driving shaft; and wherein said first driving shaft and said third driving shaft are positioned horizontally in said apparatus to be parallel to each other when said process cartridge is mounted in said apparatus.

2. The apparatus of claim 1, wherein:

said process cartridge has a plurality of developing means; and said second gear means comprises a plurality of second gears.

3. The apparatus of claim 2, wherein said process cartridge further comprises:

a plurality of second driving shafts for respectively driving each of said plurality of developing means; and wherein:

each of said plurality of second gears are respectively mounted on one of said plurality of second driving shafts; and said fourth gear means comprises a plurality of fourth gears, each of said fourth gears transferring said driving power to a respective one of said plurality of second gears when said process cartridge is mounted in said apparatus.

4. The apparatus of claim 3, wherein said third gear means comprises a gear having a smaller diameter than a diameter of a gear of said first gear means so that a rotational speed of said third driving shaft is faster than a rotational speed of said first driving shaft.

5. The apparatus of claim 4, further comprising:

transfer means for transferring said toner image onto a recording material; and wherein said photoreceptor includes an endless photoreceptor belt that forms a loop around a driving roller and a following roller; and said transfer means is disposed outside of said loop of said endless photoreceptor belt to face said driving roller, with said endless photoreceptor belt positioned between said transfer means and said driving roller.

* * * * *